United States Patent [19]

Brown

[11] 4,045,072

[45] Aug. 30, 1977

[54] ABRASION RESISTANT BOOT

[75] Inventor: Frank J. Brown, Willow Grove, Pa.

[73] Assignee: United Technology, Inc., Blue Bell, Pa.

[21] Appl. No.: 687,627

[22] Filed: May 18, 1976

[51] Int. Cl.[2] ..... B66C 1/12

[52] U.S. Cl. ..... 294/74

[58] Field of Search ..... 294/74, 75, 76, 77, 294/78, 82, 83, 84; 24/121, 122.3, 133, 33 RB, 31 B, 36, 265 EC, 265.3

[56] References Cited

U.S. PATENT DOCUMENTS

| | | | |
|---|---|---|---|
| 3,290,083 | 12/1966 | Norton | 294/74 |
| 3,310,333 | 3/1967 | Hutson | 294/74 |
| 3,592,502 | 7/1971 | Bolliger | 294/74 |

*Primary Examiner*—James B. Marbert

[57] ABSTRACT

An abrasion resistant boot of non-metallic material particularly adaptable for use in protecting a pendant or a sling. The boot is attached to the eye of the pendant where it functions to absorb large compressive stresses which might otherwise sever the pendant. Unique failure characteristics of a key element to the boot assembly, comprising a woven Dacron insert, results in the failure of fibers of the insert which are oriented in the transverse direction but not those oriented in the longitudinal direction. This enables the initial impact forces to which the pendant and protective boot are subjected to be readily absorbed without failure of the fibers in the preferred orientation and further enables the sustained stresses to be distributed over the length of the insert.

9 Claims, 3 Drawing Figures

ABRASION RESISTANT BOOT

SUMMARY OF THE INVENTION

The use of helicopters as work horses for lifting loads of substantial weight has brought about a consequent demand for pendants capable of withstanding the impact forces which result when a load is initially lifted. By "Pendant" it is understood to mean a lift component, one end of which is attached to impact force introducing means, such as a helicopter hook, and the other is attached to other lifting components or slings associated with a load. It is obviously important that the impact forces be absorbed without consequently severing of the pendant. The pendant must thereafter support such loads while they continue to be suspended in a static state.

Design constraints, imposed primarily because of the conditions under which helicopters have been used for load lifting purposes, make it possible that such pendants be of non-metallic material. A further limitation on the pendant design is the constraint imposed by the physical dimensions of the hook attached to the understructure of the helicopter with which the pendants cooperate to take up the load. Commonly, the throat of such hook configurations restrict the diametric thickness, as measured across the material portion of the eye of the pendant. The physical restriction in the case of a helicopter hook commonly employed for such purposes is approximately 2-½ inches.

Non-metallic pendants designed to satisfy the above criteria have been known to fail under loads of 67,000 lbs., whereas the particular design criteria applicable to pendants designed to be used in conjunction with the aforementioned helicopter hook calls for maximum load sustaining capability of at least 125,000 lbs. Synthetic fibers, principally of the nylon family, have commonly been used in the construction of such non-metallic pendants. Conventional pendants may either comprise a singular stranded product such as a nylon rope; or, alternatively, may comprise a laminate structure wherein several belts of nylon webbing are combined to form a laminated pendant.

Such conventionally available structures have consistently failed under loads substantially less than that specified by the current design criteria. When supplemented by the subject abrasion resistant boot however such structures have satisfied the optimum test criteria. Of particular note is the fact that the increase in load carrying capability achieved through use of the subjct boot assembly is not simply proportional to the increase in material thickness as measured over the diameter of the eye of the pendant. Rather, a percentage increase in material thickness on the order of 10% has resulted in up to 40% increase in load sustaining capability.

Although the subject boot has been particularly designed to cooperate with the eye of a pendant, the principals involved are equally applicable to other situations requiring protection against large compressive stresses. Thus, the boot assembly could be slightly reconfigured to provide protection for nylon webbing used as a restraining means for a ships cargo. The subject boot is also directly adaptable for use with slings and other support elements whether metal or non-metal.

According to the present invention, the boot assembly comprises a generally rectangular section of flexible woven nylon material to which is attached, by stitching or other means such as bonding, a less flexible cover of Cordura. In the preferred embodiment of the present invention, the Cordura cover comprises a woven tube of fluffed nylon which provides a pocket into which is inserted a strip of woven Dacron webbing material of particular weave. The Dacron webbing when subjected to large compressive stresses exhibits highly resistant abrasion characteristics and a unique failure mode. This failure mode is characterized by rupture of the transversely oriented fibers of the webbing while the longitudinal fibers merely separate but do not cut through when the webbing is subjected to highly compressive forces.

The boot assembly is positioned within the eye of a pendant and held there by tie means attached to the more flexible woven nylon material. The boot assembly is positioned within the eye of the pendant in such a manner that the Dacron webbing and protective Cordura cover are interposed between the impacting portion of the hook, attached to the helicopter or other lifting device, and the pendant proper.

In actual use, the transmission of the lifting force through the hook communicates the large compressive stresses to the boot-pendant assembly. It is when subjected to these stresses that the boot assembly exhibits its highly unusual characteristics. Thus, the longitudinal fibers of the Dacron insert which separate under the effect of the load, continue to provide effective protection to the load carrying capability of the pendant. In this respect, the longitudinally oriented fibers of the Dacron insert protect the load carrying members of the pendant against the cutting action of the sharp edges of the hook. The Cordura cover together with the Dacron insert act as a padding agent to effectively pad the pedant proper from the cutting effect of the hook. The fact that the longitudinal fibers of the Dacron webbing do not fail means that the longitudinally oriented fibers can effectively distribute the forces being applied through the hook over the length of the Dacron insert and Cordura cover.

This and other desirable features of the novel abrasion resistant boot should become more readily apparent from the following specific description of the invention.

DETAILED DESCRIPTION OF THE INVENTION

Figure 1:
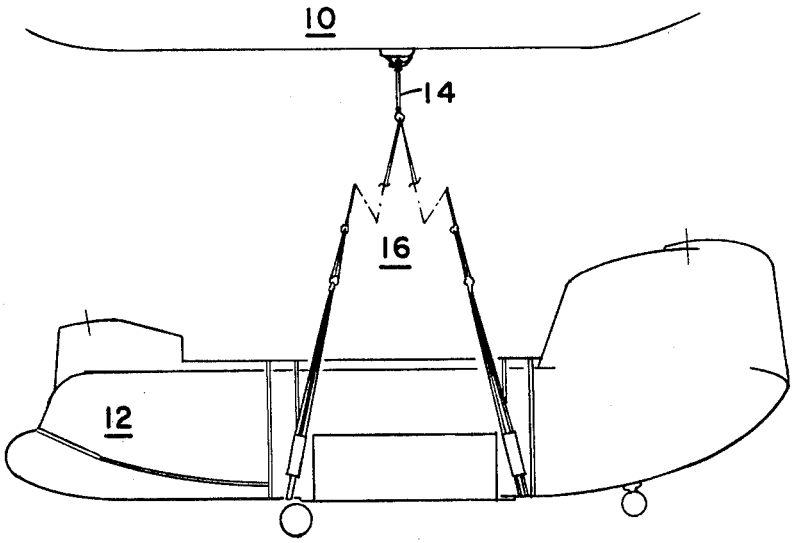
FIG. 1 is an illustration of a rigging configuration embodying the novel abrasion resistant boot of this invention.

Turning now to FIG. 1, therein is illustrated, somewhat in diagrammatic fashion, a rigging configuration being used by a first helicopter 10 to remove another disabled vehicle, in this case a second helicopter 12. The rigging comprises a pendant adapter 14 to which is attached a plurality of supplemental support elements generally indicated in the drawing as members 16 and comprising what is known in the art as a pendant assembly.

The pendant adapter 14, hereinafter referred to more generally as the pendant, of FIG. 1 comprises a primary support element. All of the operative forces are transmitted through the pendant 14. As can be seen more clearly from FIG. 2, the pendant 14 is attached to the under-belly of the helicopter 10 by means of a helicopter hook assembly 18 which includes a pin 20 and a keeper 22. The keeper 22 is pivoted so as to be retractable within the housing 24. The space separating the upper surface of the pin 20 from the housing 24 defines the throat area of the hook assembly 18 and in turn limits the diametric thickness of the pendant 14 at its eye. The eye portion of the pendant is generally depicted as member 30.

It will be noted that the pendant is a laminated structure comprising a plurality of laminates of nylon webbing 31A, 31B, 31C, 31D, and 31E, held in place by a cover 33 and a plurality of conventional "No Sews" 35. No claim is being directed to the pendant per se, which may be of conventional design. In addition to laminated pendants in the nature of that depicted in FIG. 2, other non-metallic pendants of conventional design include a rope type pendant such as is manufactured by Ocean Products Research, Inc. The abrasion resistive boot comprising the subject invention have been found to work equally well with laminated pendant structures and rope type pendants.

Interposed between the surface of the pin 20 and the inner-laminate 31A of the pendant 14 is a boot 32 constructed in accordance with the principals of the present invention.

Figure 3:
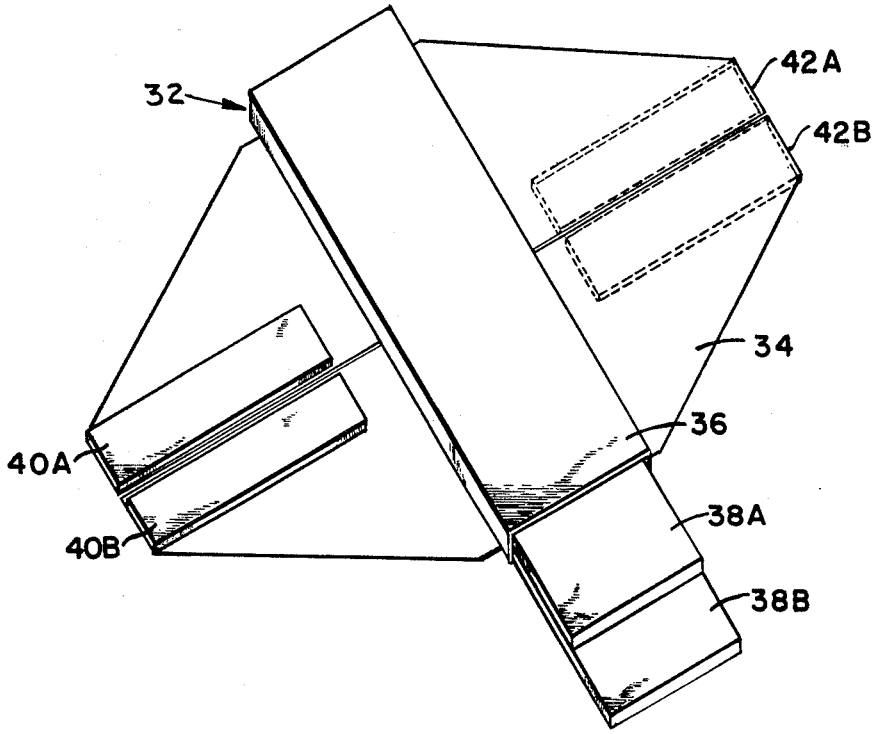

Reference is now made to FIG. 3 which discloses the details of the boot construction. In this regard the boot as viewed therein lies open on a flat surface for purposes of demonstrating its construction features.

The principal features of the boot of FIG. 3 comprise a flat piece of thin nylon fabric which alternatively may be thought of as having a generally rectangular configuration the respective corners of which have been removed, or as an octagonal structure the sides of which are unequal in length. For explanation purposes it is perhaps easier to refer to the nylon material 34 as being substantially rectangular. A piece of Cordura material substantially smaller in width than the rectangular member is attached to form a sheath of positioning the Cordura member along a diagonal connecting two non-adjacent corners of the substantially rectangular nylon member 34. The Cordura is attached to the nylon by stitching or, alternatively, may be bonded by any other conventional technique.

The Cordura sheath 36 forms protective pocket within which two lengths of Dacron polyester webbing, 38A and 38B, exhibiting the desirable design characteristics of the subject invention, are inserted. The dacron polyester webbing is conventionally available as Type XXVI under Military Specification No. MIL-W-25361B. Although conventionally available, heretofore, the aforementioned Dacron polyester webbing has not been used in the capacity of an insert for a protective boot, nor have its unique failure characteristics been known or taken advantage of in providing impact stress resistance to conventional pendants.

FIG. 3 depicts two strips of dacron polyester webbing 38A and 38B partially withdrawn from the protective cordura sheet 36. It should, of course, be apparent that when the boot of FIG. 3 is used the dacron polyester webbing is entirely concealed within the protective pocket of the Cordura sheath 36. After the inserts 38A and 38B are positioned with the Cordura sheath, the latter is closed at both ends, preferably by heating sealing.

It should be noted that the portion of the nylon material 34 extending to either side of the Cordura sheath 36 are slit to form two relatively independent flaps. Mounted on each one of the two flaps extending from one side of the Cordura sheath are lengths of Velcro pile material 40A and 40B approximately 1 inch wide and 3 inches long. The pieces of Velcro pile 40A and 40B are sewn to the nylon cover. Attached to the opposite side of the other two flaps are two Velcro "hooks" 42A and 42B of approximately the same dimensions as the members 40A and 40B.

Figure 2:
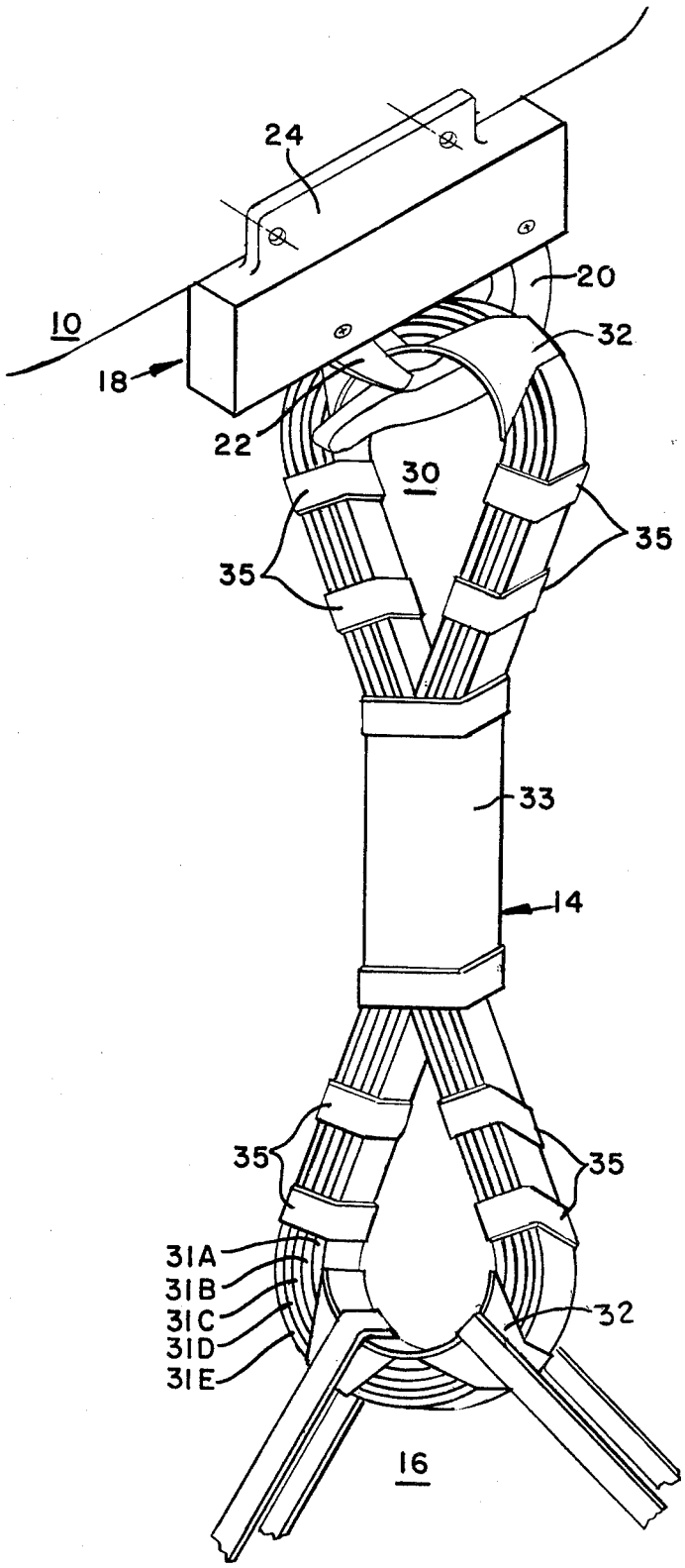
FIG. 2 is an enlargement of the portion of FIG. 1 showing in more detail the novel abrasion resistant boot in operative realtionship with cooperating members of the rigging configuration; and, FIG. 3 is a detailed representation of the novel abrasion resistant boot assembly constructed in accordance with the principles of the present invention.

As can be seen more clearly from the view of the protective boot disclosed in FIG. 2, the bifurcated nature of the nylon cover 34 permits the boot to more easily conform to the physical shape of the pendant eye 30. The boot is mounted in such a manner that the Cordura cover projects outwardly into the space comprising the eye of the pendant. The Velcro pile and hook cooperate in a conventional manner to facilitate the ready fastening of the boot within the inner eye of the pendant and maintain the boot in position.

In actual use, the results achieved with the boot are in no way linearly proportional to the increase in material thickness over the diammetric eye of the pendant. In this respect, the thicknes of the boot, as measured through the Cordura cover, insert and nylon cover, is on the order of 0.2 inches. This is to be contrasted to the approximately 2 inch thickness of the conventional pendant as measured diammetrically at the eye of the pendant. The approximate 10% increase in material thickness contributed by the boot is to be contrasted with an increase in load sustaining capability of up to 40% which is realized thereby.

In an actual test it was found that a pendant, of conventional design which had theretofore failed under static and dynamic load tests when subjected to loads of 92,400 lbs., was, when equipped with the subject boot, capable of withstanding loads of 132,400 lbs. under identical test conditions. Other tests have substantiated the adaptability of the subject boot for use in conjunction with nylon rope pendants as well as laminated pendant structures.

Although the exact reason for the phenomenal success realized by attaching the novel protective boot to pendants of conventional design is not fully understood, it is apparent that the Dacron insert seemingly exhibits unique failure characteristics whereby the longitudinally oriented fibers experience a separation with respect to adjacent fibers. Under maximum load, failure of the longitudinally oriented fibers does not occur while the fibers oriented in the transverse direction are observed to fail at something less than maximum. It is important to note that the orientation of the longitudinal fibers in the subject boot assembly is such that even though failure of the transverse fibers occurs, the longitudinal fibers are available to distribute the stresses around the eye of the pendant over the operative length of the insert. The result is that once the dynamic impact has been absorbed by the pendant, the longitudinal fibers are available to continue to carry the load and distribute the operative forces over a corresponding portion of the pendant eye.

Were it not for the selective failure, the stresses at maximum load would sever the longitudinal fibers thus subjecting the protective nylon laminates to the compressive stresses of the loads. If this were allowed to occur, a domino effect would take place with the result that the pendant would experience failure of successive laminates leading to the ultimate failure of the pendant itself.

In addition to the unique failure characteristics of the Dacron inset, the Cordura cover and the insert together play a functional role in padding the pendant from the otherwise cutting edges of the pin 20 of the helicopter hook assembly 18. This padding effect in essence enlarges the radial contact of the surfaces of the pin 20 with respect to the inner diametric laminate 31A of the product 14. This, in turn, effects a substantial reduction in the pressure otherwise experienced by the inner diametric laminate 31A of the pendant 14 where the pendant comes into direct contact with the pin 20. The relatively high resistivity to compression loads which characterizes the boot assembly enables the latter to sustain compressive stresses far in excess of those which would otherwise sever the nylon laminates of a conventional pendant.

Another very beneficial result obtained through use of the boot assembly is the protection it affords to the pendant. The fact that the boot assembly is a disposable item further means that it can be discarded after several uses. Since the abrasive forces are primarily absorbed by the boot assembly, the wear is also primarily restricted to the boot. Thus, replacement of the boot permits the pendant/boot assembly to be refurbished without entailing substantial expense in reconstruction of the pendant per se. This has the consequential effect of prolonging the life of the pendant.

The beneficial effects realized through use of the subject protective boot cannot be attributed to the Cordura cover alone since conventional pendants are known which utilize a layer of Cordura material to isolate the nylon webbing from direct contact with the pin 20 of the helicopter hook assembly 18; however, such use of the Cordura material has not measurably increased the resistivity to compressive stresses nor enabled such conventional pendants to withstand the maximum load capable of being withstood when such pendants are equipped with the subject protective boot.

It is, of course, understood that numerous changes can be made in the details of the protective boot without departing from the spirit or scope of this invention. For example, the nylon cover can be replaced or eliminated and other means used to securely position the Cordura sheath and its Dacron inserts within the inner eye of the pendant. Alternatively, other configurations for the nylon cover can be used and different tie means provided. It should also be possible to realize the same beneficial effects as are realized from the novel boot assembly should the operative portion of the boot assembly be adapted for use in securing cargo. Thus, it should of course be understood that while this invention has been described with respect to a particular embodiment thereof, numerous others will become obvious to those with ordinary skill in the art in light thereof.

What is claimed is:

1. A protective boot for use in conjunction with a support member, said boot comprising a first member of relatively flexible material, a second member of relatively inflexible material attached to said first member, said second member being somewhat smaller in width than said first member and being of such configuration so as to form a pocket, and an insert of a size to substantially fill said pocket, said insert comprising a woven member exhibiting preferred characteristics when subjected to large compressive stresses whereby longitudinally oriented fibers of said woven member exhibit a relatively high resistivity to compression while the transversely oriented fibers exhibit a relatively low resistivity to compression so that when said boot is subjected to impact forces of substantial magnitude a failure of the transversely oriented fibers occurs without a corresponding failure of the longitudinally oriented fibers thereby permitting the impact forces to be distributed over the length of said insert.

2. The protective boot of claim 1 wherein said first member is substantially rectangular and formed of woven nylon cloth.

3. The protective boot boot claim 1 further comprising Velcro tie means for securing said boot to a cooperating structure to be protected.

4. The protective boot of claim 1 wherein said second member comprises a woven tube of fluffed nylon material.

5. The protective boot of claim 1 wherein said insert comprises a Dacron webbing of type XXVI having a military specification number MIL-W-25361B.

6. The apparatus of claim 1 wherein a plurality of Dacron inserts are insertable into said pocket thus increasing the maximum load sustaining ability of a pendant of conventional design constructed of plural laminates of nylon webbing and/or nylon rope and having the diametric thickness of the eye of the pendant of approximately two inches, by some 40% so as to withstand loads of up to 125,000 lbs.

7. A disposable boot for use in conjunction with a non-metallic support member, comprising a substantially rectangular flat section of woven nylon material, a cover comprising a fluffed nylon tube attached to said rectangular section of woven nylon material and forming a protective pocket which extends along said cover being substantially rectangular in shape and extending substantially the entire length of the diagonal connecting two non-adjacent corners of said substantially rectangular section of woven nylon material, each of the other two non-adjacent corners of said rectangular member of woven nylon material being bifurcated and provided with tie means to enable said disposable boot to be secured to a pendant to be protected, and a woven insert of Dacron material of substantially rectangular configuration and of a size designed to be readily accommodated within said protective pocket.

8. The apparatus of claim 7 wherein the fibers comprising said Dacron are further characterized in that the longitudinally oriented fibers have a relatively high resistivity to compression factor while the transversely oriented fibers exhibit a relatively low resistivity to compression factor whereby the application of substantial impact force to said disposable boot will result in the failure of the transversely oriented fiber while the longitudinally oriented fibers will not fail and will continue to be available to distribute the operative forces over the length of said insert.

9. A non-metallic apparatus capable of absorbing the initial impact of highly compressive stresses and after being subjected to such stresses capable of distributing the sustained stresses over the effective length thereof, comprising a woven member, said woven member having longitudinally oriented fibers which exhibit a substantial resistivity to compression loads and transverse fibers which exhibit a relatively lesser resistivity to compression loads than do said longitudinally oriented fibers, said transversely oriented fibers being more readily disposed to failure when subject to substantial impact stresses while adjacent ones of said longitudinally oriented fibers exhibit a tendency to separate when subjected to said substantial stresses but do not fail.

* * * * *